US006616373B1

(12) United States Patent
Kennedy

(10) Patent No.: US 6,616,373 B1
(45) Date of Patent: Sep. 9, 2003

(54) BOAT LAUNCHING DEVICE AND METHOD

(76) Inventor: James L. Kennedy, Rt. 1, Box 175, Clifton, AZ (US) 85533

( * ) Notice: Subject to any disclaimer, the term of this patent is extended or adjusted under 35 U.S.C. 154(b) by 0 days.

(21) Appl. No.: 10/128,971

(22) Filed: Apr. 24, 2002

(51) Int. Cl.[7] ..... B63C 3/00

(52) U.S. Cl. ..... 405/1; 114/344; 280/414.1; 280/476.1; 280/481

(58) Field of Search ..... 114/344; 405/1; 280/476.1, 481, 502, 414.1, 414.2, 414.3

(56) References Cited

U.S. PATENT DOCUMENTS

| | | | | | |
|---|---|---|---|---|---|
| 2,782,944 | A | * | 2/1957 | Macklin | 414/563 |
| 2,821,410 | A | * | 1/1958 | Love | 280/476.1 |
| 2,828,973 | A | * | 4/1958 | Blackman | 280/476.1 |
| 3,072,419 | A | * | 1/1963 | Safford | 280/406.2 |
| 3,622,181 | A | * | 11/1971 | Smith | 280/476.1 |
| 3,649,049 | A | * | 3/1972 | Woodke, III | 280/502 |
| 3,794,355 | A | * | 2/1974 | Cracolice | 280/482 |
| 3,806,162 | A | * | 4/1974 | Milner | 280/502 |
| 3,858,908 | A | | 1/1975 | Frank | |
| 3,899,195 | A | | 8/1975 | Rudder, Jr. | |
| 4,113,126 | A | | 9/1978 | Shotwell | |
| 4,266,800 | A | * | 5/1981 | Hawkins | 280/491.4 |
| 4,277,081 | A | | 7/1981 | Stoutenburg | |
| 4,407,519 | A | * | 10/1983 | Heyser | 280/482 |
| 4,645,226 | A | * | 2/1987 | Gustavsson et al. | 280/476.1 |
| 4,697,976 | A | | 10/1987 | Godbersen | |
| 4,867,469 | A | | 9/1989 | Freeman | |
| 5,380,143 | A | * | 1/1995 | Mohan | 414/495 |
| 5,799,962 | A | | 9/1998 | Barnhart | |

* cited by examiner

*Primary Examiner*—Robert J. Sandy
*Assistant Examiner*—Katherine Mitchell
(74) *Attorney, Agent, or Firm*—Gavin J. Milczarek-Desai; Durando Birdwell & Janke P.L.C.

(57) ABSTRACT

A boat launching device. The boat launching device is portable and attaches to the front of a vehicle so that the driver has a front view while launching the boat into the water. The boat launching device includes a first link member that is connected to a second link member. The link members are attached to the front of a vehicle and to a boat trailer. The link members are detachable from each other after use and may be stored on the boat trailer.

2 Claims, 3 Drawing Sheets

BOAT LAUNCHING DEVICE AND METHOD

FIELD OF THE INVENTION

This invention relates to a boat launching device and method which attaches to the front of a vehicle, for launching the boat into a body of water.

BACKGROUND OF THE INVENTION

Recreational boaters typically transport the boat to a body of water by pulling a trailer that carries the boat with a towing vehicle. Once the boat has been transported to the water, it must be launched into the water, and the vehicle must typically be backed down a loading ramp. This is a difficult task because of the vehicle driver's limited view using the vehicle's rear window and side mirrors, and because it is physically difficult to maneuver the trailer while backing down a boat ramp. Many times the vehicle is backed in too far and it becomes wet. This is particularly troublesome with salt water which readily corrodes metal. In addition, the boat can be damaged if it is accidentally backed into a wall.

A proposed solution to the problem of improving maneuverability is provided in U.S. Pat. No. 4,867,469 to Freeman, which discloses a front mounted trailer hitch comprising a steel plate that supports a ball hitch at its front end and an adjustable anchoring member for connection to the front bumper of a vehicle. Another is found in U.S. Pat. No. 3,899,195 to Rudder, Jr., which discloses a front mounted vehicle hitch comprising a heavy bar support having a ball at one end for attachment to a boat trailer and a securing member for attachment to the front bumper of a vehicle by the bumper bolt. In addition, U.S. Pat. No. 4,277,081 to Stoutenburg discloses a trailer hitch for mounting on either the front or rear of a vehicle bumper. It has a bumper catch for attaching to the vehicle's bumper and a ball for connection to a trailer. A disadvantage of these devices is that they provide only a short space between the vehicle and a boat so that the vehicle is likely to get wet when the hitch is used to launch the boat into the water.

Therefore, there is a need to provide a boat launching device and method that attaches to the front end of a vehicle, that prevents the vehicle from getting wet when the boat is being launched, that is portable and can be detached after each use, and that is easy to maneuver and inexpensive to manufacture.

SUMMARY OF THE INVENTION

The boat launching device and method of the present invention solves the aforementioned problems and meets the aforementioned needs by providing a portable boat launching device that attaches to the front of a vehicle so that the driver has a front view while launching the boat into the water. The boat launching device includes a first link member having two ends and a second link member having two ends. One end of the first link member pivotally attaches to the midpoint of the second link member. The other end of the first link member and one of the ends of the second link member attach to the front of the vehicle. The other end of the second link member attaches to a boat trailer. A caster is attached to the second link member near the end that attaches to the boat trailer. The vehicle can be used to forwardly launch the boat down a boat ramp without getting the vehicle wet. After use, the first link member can be detached from or pivoted with respect to the second link member and the boat launching device can be stored underneath the boat on the boat trailer.

Therefore, it is a principal object of the present invention to provide a novel and improved boat launching device and method.

It is another object of the present invention to provide a boat launching device and method that is adapted to be attached to the front end of a vehicle for launching the boat.

It is yet another object of the present invention to provide a boat launching device and method that prevents the vehicle from getting wet when the boat is being launched.

It is a further object of the present invention to provide a boat launching device and method that is lightweight, portable, detachable, and that can be easily disassembled and stored on the boat trailer after use.

It is a still further object of the present invention to provide a boat launching device and method that is easy to maneuver and inexpensive to manufacture.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
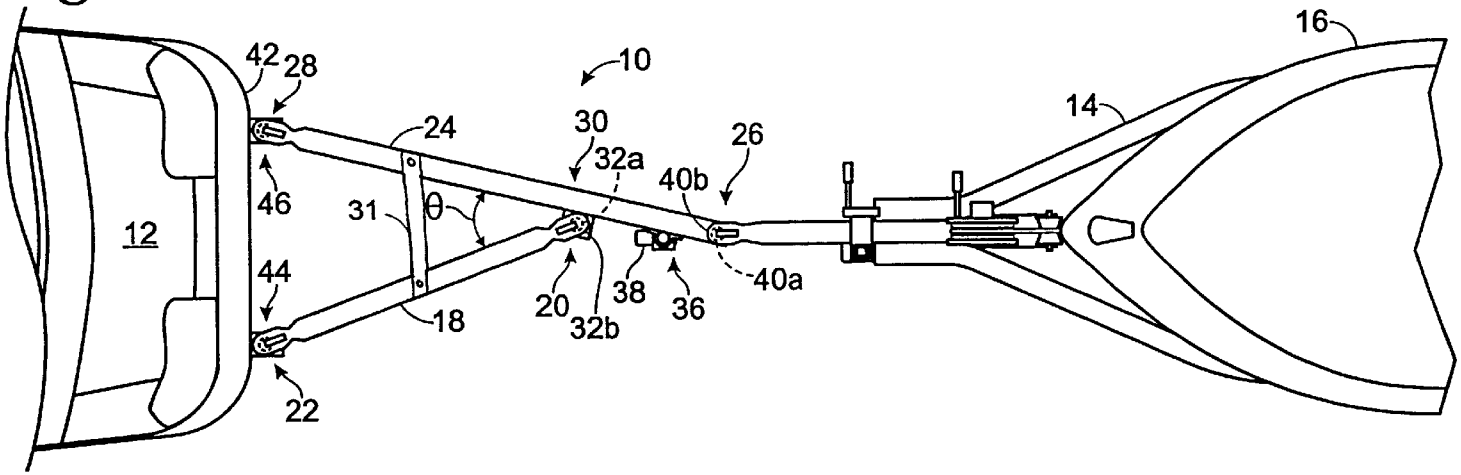
FIG. 1 is a schematic top view of a boat launching device according to the present invention shown attached to the front end of a vehicle and to a boat trailer.

A boat launching device 10 according to the present invention is shown in FIG. 1. The boat launching device 10 is most advantageously attached to the front end of a vehicle 12, for pushing a boat trailer 14 for carrying a boat 16. The front end of the vehicle 12 is oriented toward the direction in which the driver faces while operating the vehicle 12. The vehicle 12 is driven forward down a loading ramp to launch the boat 16 into the water. However, the boat launching device 10 may also be used for any other purpose without depailing from the principles of the invention.

The boat launching device 10 includes a first link member 18 having a first end 20 and a second end 22. The boat launching device 10 further includes a second link member 24 having a first end 26, a second end 28, and a "midpoint" 30 which is preferably located about a ¾ distance along the length of the second link member 24 measured from the front of vehicle. However, the midpoint may be considered to be any point between the ends of the second link member 24. The link members are preferably attached to a brace 31, which aides in steadying the link members during the boat launching process. In addition, the link members are preferably rectangular or square straight tubing, but other configurations can be used without departing from the principles of the invention. The first end 20 of the first link member 18 is connected to the second link member 24 at the midpoint 30. The first and second link members 18 and 24 form a substantially y-shaped configuration with an angle θ that is preferably approximately 45 degrees. The link members are preferably formed of metal for high strength and toughness, but other materials can be used without departing from the principles of the invention. The length of the second link member is approximately 10 feet to provide sufficient distance between the boat trailer and the vehicle so that the vehicle does not get wet when launching the boat into the water. However, other lengths can be used for different applications without departing from the principles of the invention.

Figure 2:
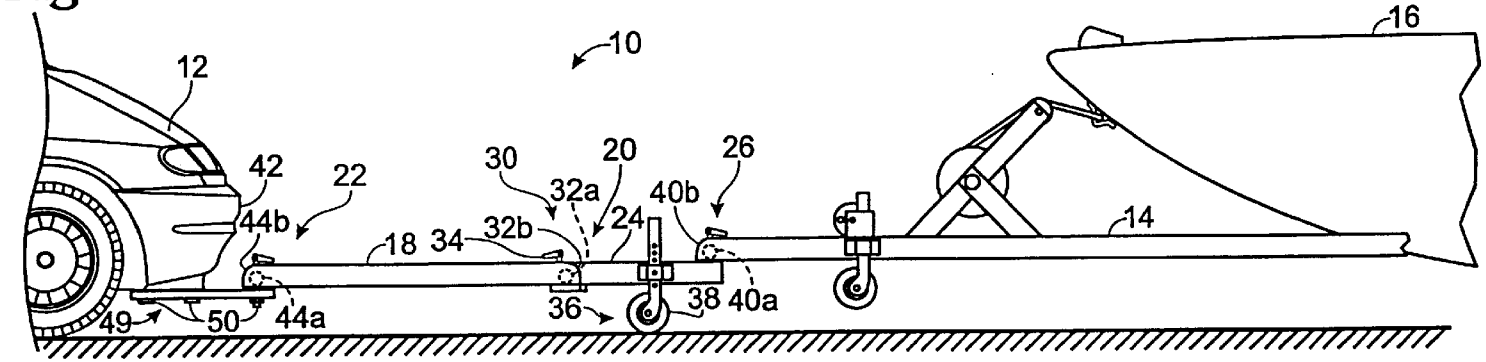
FIG. 2 is a schematic side view of the boat launching device of FIG. 1.

As shown in FIG. 2, the first link member 18 has an attachment means or member 32*a* that attaches to a corresponding attachment member 32*b* of the second link member 24, located at the midpoint 30 to couple the members 18 and 24 together. Preferably the attachment members 32*a* and 32*b* form a ball and ball receiver combination which is commonly used for towing. The ball receiver 32*b* fits over the ball 32*a* and press fits with a lever 34. In this form, the attachment members 32 pivot about a first axis "A1" that is perpendicular to the plane of the paper and a second axis "A2" that is parallel to the plane of the paper. This provides maximum flexibility for pivotal coupling about either axis, but it is not essential to the invention to provide for pivoting about either axis. The first and second link members can even be welded together; however the link members are easier to manipulate, carry and store when they are detachable.

Figure 3:
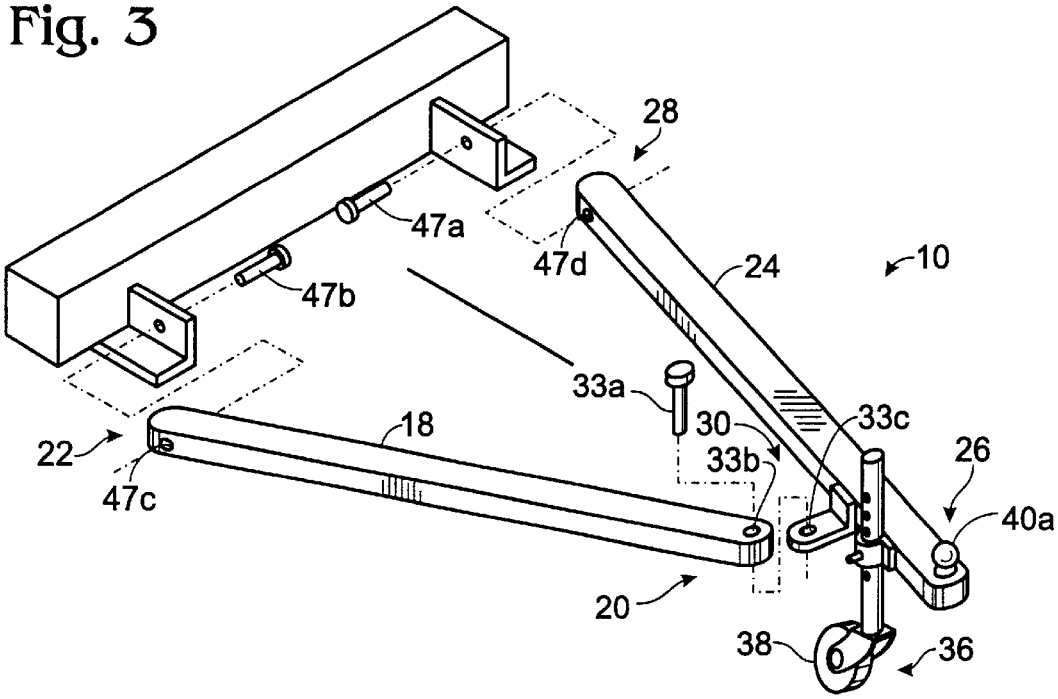
FIG. 3 is a pictorial view of the boat launching in a disassembled state.

FIG. 3 shows the boat launching device 10 in a disassembled state using alternative attachment members. Pin 33*a* fits into apertures 33*b* in the first link member 18 and 33*c* in the second link member 24. In this form, the attachment members pivot about the first axis "A1." The ball and ball receiver attachment members offer a greater range of motion and are less expensive to manufacture. However, other attachment members can be used without departing from the principles of the invention. For example, the attachment members may be corresponding concentrically disposed, slidably coupled tubes, etc.

Returning to FIG. 2, a caster 36 adapted for swiveling about the first axis "A1" preferably is attached to the second link member 24 to support the device 10. Preferably, a wheel 38 of the caster 36 features an pneumatic tire that is about a 10 to 12 inch diameter and has a 500 pound capacity; however, other wheel characteristics may be employed, and the caster may have any number of wheels.

For attaching the boat trailer 14 to the device 10, the first end 26 of the second link member 24 has an attachment member 40*a* that attaches to a corresponding attachment member 40*b* on the boat trailer. A respective ball 40*a* and ball receiver 40*b* are preferred attachment devices, but other standard attachment devices used for towing may also be used.

Figure 4:
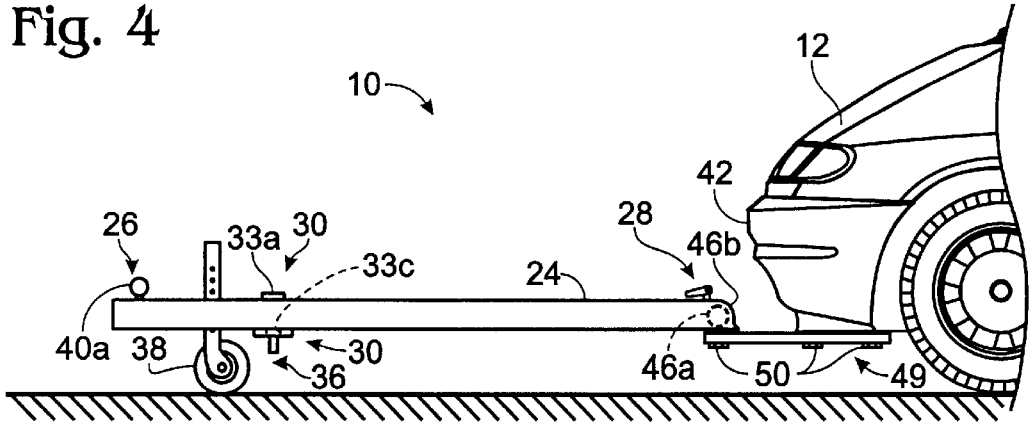
FIG. 4 is a schematic side view of the other side of the boat launching device of FIG. 1.
Figure 5:
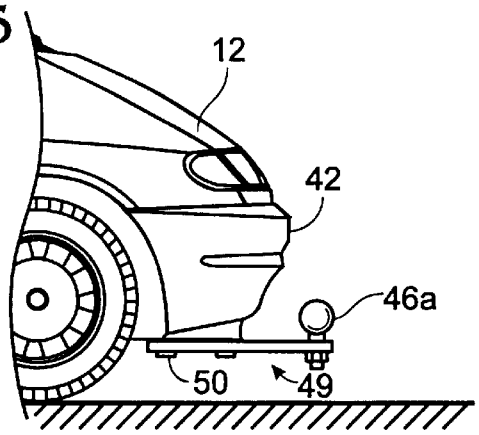
FIG. 5 is a schematic side view of an attachment mechanism that attaches a boat launching device to a front end of a vehicle according to the present invention.
Figure 6:
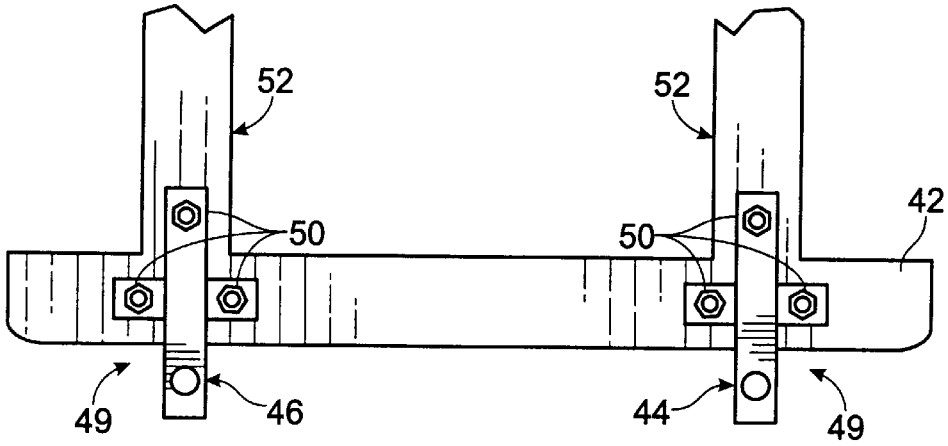
FIG. 6 is a schematic bottom view of the attachment mechanism of FIG. 5.

To couple the device 10 to the vehicle 12, the second end 22 of the first link member 18 attaches to the front end 42 of the vehicle by respective attachment members 44*a* and 44*b*. The attachment members 44 are preferably a ball and ball receiver 44*a* and 44*b*. As shown in FIG. 4, the second end 28 of the second link member 24 similarly attaches to the front end 42 of the vehicle by attachment members 46*a* and 46*b*. The attachment members 46 are also preferably a ball and ball receiver 46*a* and 46*b*. The attachment members 44 and 46 provide for pivoting about the first axis "A1" and the second axis "A2" to allow for changes in the ramp angle between the vehicle 12 and the boat trailer 14 when it is being launched down the ramp. However, other standard attachment devices such as pins 47*a* and 47*b* that fit into apertures 47*c* on the first link member 18 and 47*d* on the second link member as shown in FIG. 3 can be used; however, the ball and socket attachment members are less expensive to manufacture and offer a greater range of motion. FIGS. 5 and 6 show that attachment members 44*a* and 46*a* are attached to a coupling mechanism 49 which is bolted 50 to a frame 52 of the vehicle 12. Other configurations of the attachment members may be employed without departing from the principles of the invention.

Figure 7:
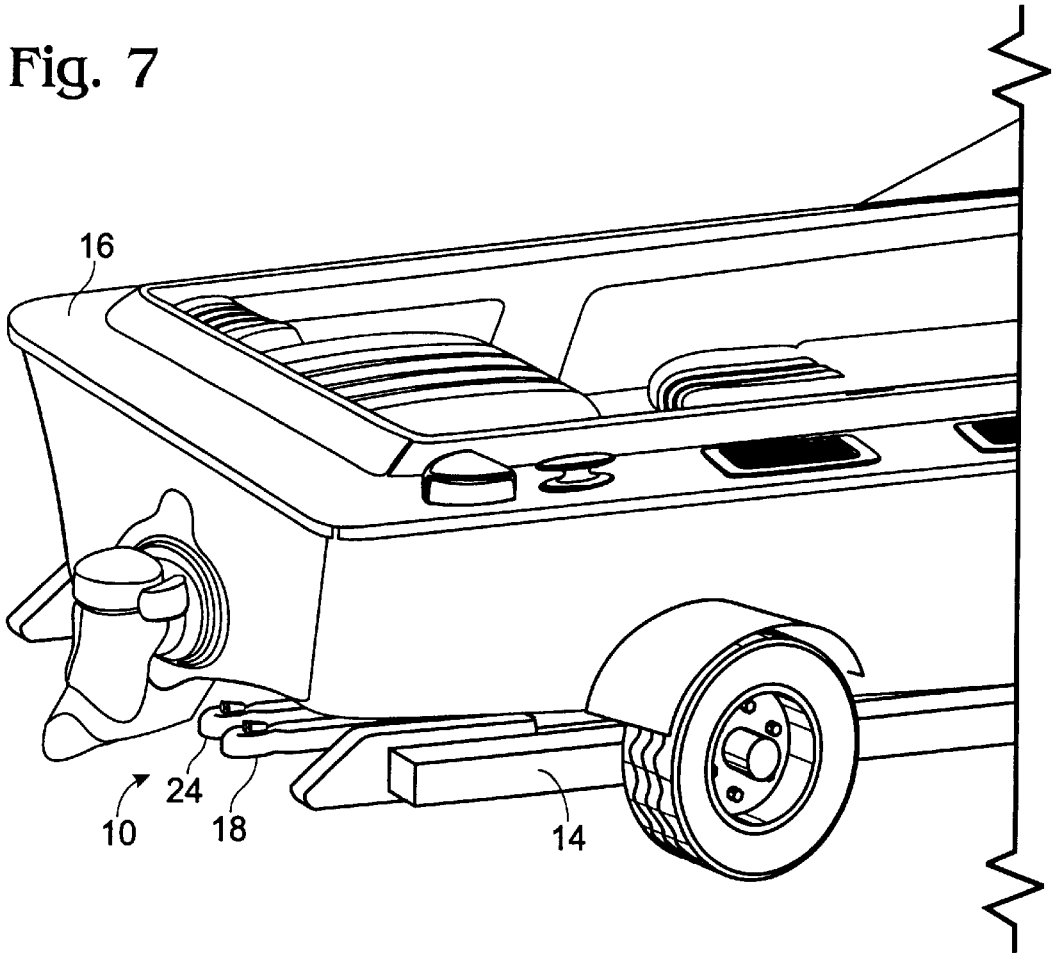
FIG. 7 is pictorial view of the boat launching device of FIG. 1 shown disassembled and stored on a boat trailer.

Referring to FIG. 7, the first 18 and second 24 link members are attachable to and detachable from each other so that the boat launching device 10 can be easily disassembled and stored on the boat trailer 14 before and after use.

For use of the device 10, the boat 16 is loaded on the trailer 14, which in turn is attached to the back of the vehicle 12 as is standard towing practice. The disassembled boat launching device 10 is stored on the trailer underneath the boat. The device 10 may be removed from the trailer 14 and the first link member 18 is attached to the second link member 24 at its midpoint 30. The attachment device 40*b* on the trailer 14 is removed from the back of the vehicle 12 and the trailer 14 is moved to the front end 42 of the vehicle and attached via the attachment member 40*a* to the first end 26 of the second attachment member 24. The ball receivers 44*b* and 46*b* on the first 18 and second 24 link members are attached respectively to the balls 44*a* and 46*a* mounted on the front end 42. The vehicle is driven forward down the launch ramp to launch the boat into the water. Because the vehicle is facing forward, the driver has a better view of the boat and it is easier to maneuver the boat. The second link member is long enough so that it is not necessary to drive the vehicle into the water in order to launch the boat. The device is relatively light in weight and easy to handle, making it easy to move and store.

It is to be recognized that, while a particular boat launching device and method has been shown and described as preferred, other configurations and methods will be utilized, in addition to those already mentioned, without departing from the principles of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method for launching a boat into a body of water by use of a motor vehicle having a front end, comprising:

(a) providing a boat launching device including a first link member, including a first means for attaching an end thereof to the front end of a vehicle, a second link member, including a second means for attaching an end thereof to the front end of the vehicle, a coupling means for attaching a second end of said first link member to said second link member, and a third means for attaching a second end of said second link member to a boat trailer and supporting the second end of the second link member above ground, (b) attaching said first and said second means for attaching to the front end of the vehicle; and (c) attaching said third means for attaching to a boat trailer.

2. The method of claim 1, further comprising driving the vehicle forward so that the boat trailer descends down a ramp into water.

* * * * *